US005466932A

United States Patent [19]

Young et al.

[11] Patent Number: 5,466,932

[45] Date of Patent: Nov. 14, 1995

[54] MICRO-MINIATURE PIEZOELECTRIC DIAPHRAGM PUMP FOR THE LOW PRESSURE PUMPING OF GASES

[75] Inventors: Robert M. Young, Pittsburgh; Carl B. Freidhoff, Murrysville, both of Pa.; Dennis L. Polla, Brooklyn Park; Peter J. Schiller, Plymouth, both of Minn.

[73] Assignee: Westinghouse Electric Corp., Baltimore, Md.

[21] Appl. No.: 320,614

[22] Filed: Oct. 7, 1994

Related U.S. Application Data

[63] Continuation-in-part of Ser. No. 124,873, Sep. 22, 1993, Pat. No. 5,386,115.

[51] Int. Cl.[6] ..... H01J 49/24; F04B 17/00

[52] U.S. Cl. ..... 250/289; 417/413.2

[58] Field of Search ..... 250/289; 417/413.2

[56] References Cited

U.S. PATENT DOCUMENTS

| | | | |
|---|---|---|---|
| 4,938,742 | 7/1990 | Smits | 604/67 |
| 5,209,119 | 5/1993 | Polla et al. | 73/723 |
| 5,338,164 | 8/1994 | Sutton et al. | 417/413.2 |
| 5,386,115 | 1/1995 | Freidhoff et al. | 250/281 |

OTHER PUBLICATIONS

W. J. Spencer, "An Electronically Controlled Piezoelectric Insulin Pump and Valves", *IEEE Trans, Sonics and Ulstrasonic,* vol. SU–25, No. 3, p. 153 (1978).

H. T. G. VanLintel et al., "A Piezoelectric Micropump Based on MIcromachining of Silicon", 15 *Sensors and Actuators* 153 (1988).

J. G. Smits, "Piezoelectric Micropump With Three Valves Working Peristaltically", A21 *Sensors and Actuators* 203 (1990).

J. W. Judy et al., "Surface–Machined Micromechanical Membrane Pump", *Proceedings of IEEE Micro Electro* Mechnical Systems (Nara. Japan), (1991).

P. Schiller et al., "Design And Process Considerations For Ferroelectric Film–Based Piezoelectric Pressure Sensors", *4th International Symposium on Integrated Ferroelectrics* (1992).

P. Schiller et al. "Integrated Piezoelectric Microactuators Based on PZT Thin Films", *7th International Conference on Solid State Sensors And Actuators,* p. 154 (1993).

R. Bruchhaus et al., "Investigation of Pt Bottom Electrodes For 'In–Situ' Deposited Pb (Zr,Ti) $O_3$ (PZT)Thin Films", 2453 *MRS Symp. Proc.* 101 (1991).

K. Streenivas et al., "Investigation of Pt/Ti Bilayer Metallization on Silicon For Ferroelectric Thin Film Integration", 75(1) *J. Appl. Phys.* 232 (1994).

*Primary Examiner*—Jack I. Berman

*Attorney, Agent, or Firm*—Walter G. Sutcliff

[57] ABSTRACT

A pump is provided for use in a solid state mass-spectrograph for analyzing a sample gas. The spectrograph is formed from a semiconductor substrate having a cavity with an inlet, gas ionizing section adjacent the inlet, a mass filter section adjacent the gas ionizing section and a detector section adjacent the mass filter section. The pump is connected to each of the sections of said cavity and evacuates the cavity and draws the sample gas into the cavity. The pump includes at least one piezoelectrically-actuated diaphragm. Upon piezoelectrical actuation, the diaphragm accomplishes a suction stroke which evacuates the cavity and draws the sample gas into the cavity. Preferably, the diaphragm is formed from a pair of electrodes sandwiching a piezoelectric layer.

29 Claims, 4 Drawing Sheets

FIG. 3
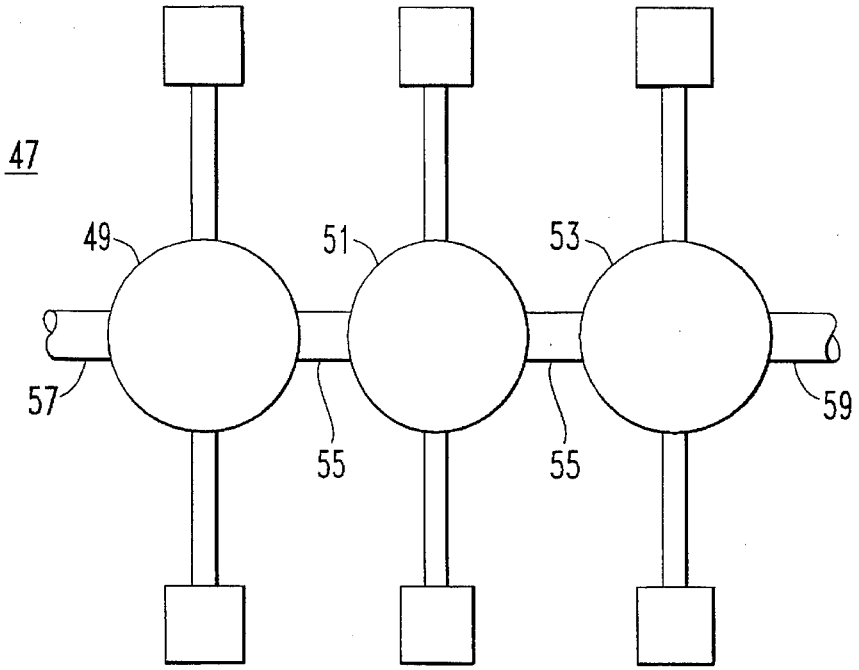
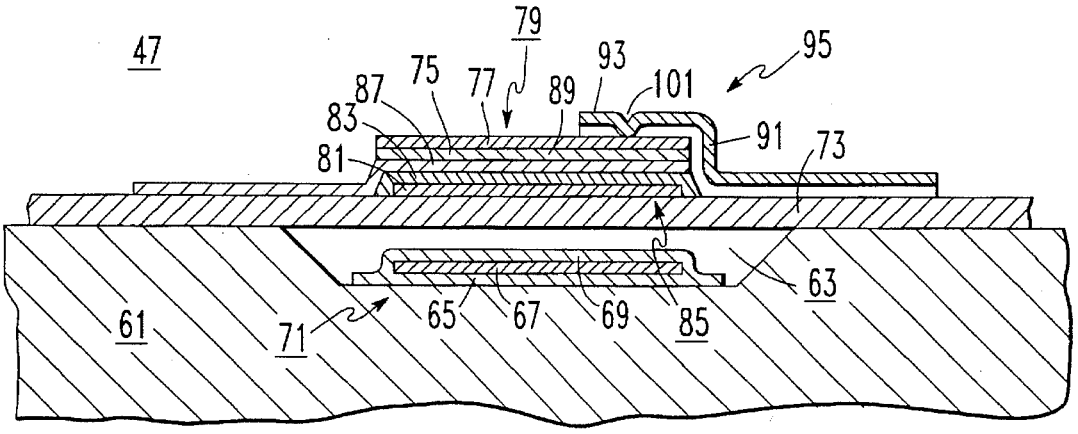
FIG. 4

FIG. 5
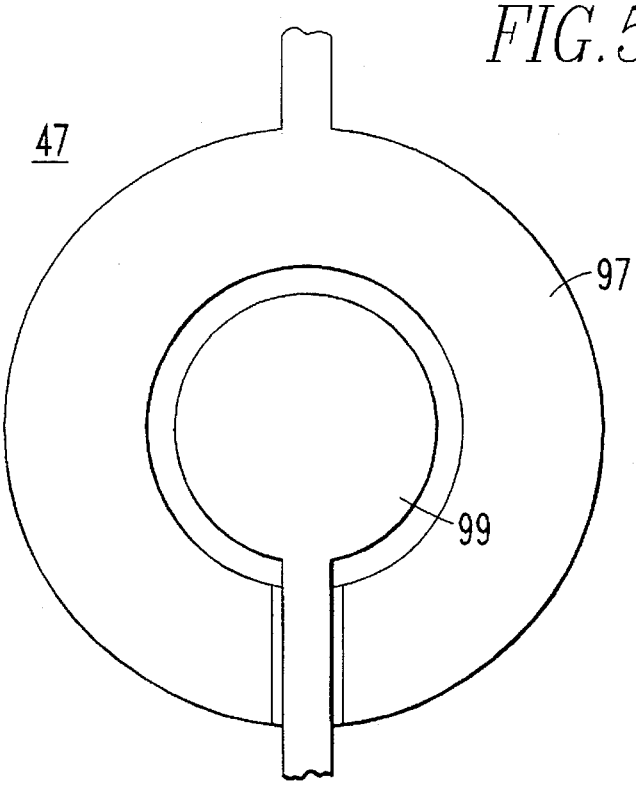
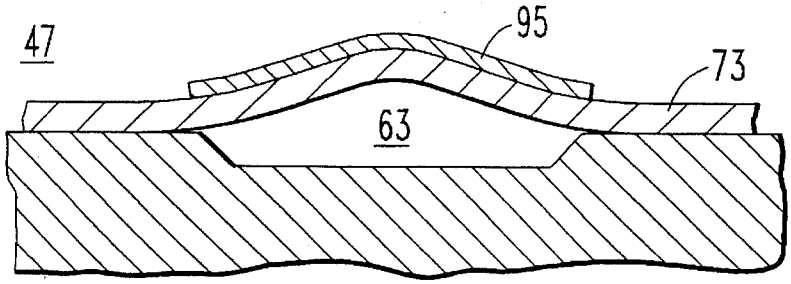
FIG. 6

MICRO-MINIATURE PIEZOELECTRIC DIAPHRAGM PUMP FOR THE LOW PRESSURE PUMPING OF GASES

GOVERNMENT CONTRACT

The government of the United States of America has rights in this invention pursuant to Contract No. 92-F-141500-000, awarded by the United States Department of Defense, Defense Advanced Research Projects Agency.

CONTINUING APPLICATION

This application is a continuation-in-part of application Ser. No. 08/124,873, filed Sep. 22, 1993, now U.S. Pat. No. 5,386,115.

BACKGROUND OF THE INVENTION

1. Field of the Invention

This invention relates to a gas-detection sensor and more particularly to a solid state mass spectrograph which is micro-machined on a semiconductor substrate, and, even more particularly, to a diaphragm pump for the low pressure pumping of gases used in such a mass spectrograph.

2. Description of the Prior Art

Various devices are currently available for determining the quantity and type of molecules present in a gas sample. One such device is the mass-spectrometer.

Mass-spectrometers determine the quantity and type of molecules present in a gas sample by measuring their masses. This is accomplished by ionizing a small sample and then using electric and/or magnetic fields to find a charge-to-mass ratio of the ion. Current mass-spectrometers are bulky, bench-top sized instruments. These mass-spectrometers are heavy (100 pounds) and expensive. Their big advantage is that they can be used in any environment.

Another device used to determine the quantity and type of molecules present in a gas sample is a chemical sensor. These can be purchased for a low cost, but these sensors must be calibrated to work in a specific environment and are sensitive to a limited number of chemicals. Therefore, multiple sensors are needed in complex environments.

A need exists for a low-cost gas detection sensor that will work in any environment. U.S. patent application Ser. No. 08/124,873, filed Sep. 22, 1993, hereby incorporated by reference, discloses a solid state mass-spectrograph which can be implemented on a semiconductor substrate. FIG. 1 illustrates a functional diagram of such a mass-spectrograph 1. This mass-spectrograph 1 is capable of simultaneously detecting a plurality of constituents in a sample gas. This sample gas enters the spectrograph 1 through dust filter 3 which keeps particulate from clogging the gas sampling path. This sample gas then moves through a sample orifice 5 to a gas ionizer 7 where it is ionized by electron bombardment, energetic particles from nuclear decays, or in an electrical discharge plasma. Ion optics 9 accelerate and focus the ions through a mass filter 11. The mass filter 11 applies a strong electromagnetic field to the ion beam. Mass filters which utilize primarily magnetic fields appear to be best suited for the miniature mass-spectrograph since the required magnetic field of about 1 Tesla (10,000 gauss) is easily achieved in a compact, permanent magnet design. Ions of the sample gas that are accelerated to the same energy will describe circular paths when exposed in the mass-filter 11 to a homogenous magnetic field perpendicular to the ion's direction of travel. The radius of the arc of the path is dependent upon the ion's mass-to-charge ratio. The mass-filter 11 is preferably a Wien filter in which crossed electrostatic and magnetic fields produce a constant velocity-filtered ion beam 13 in which the ions are disbursed according to their mass/charge ratio in a dispersion plane which is in the plane of FIG. 1.

A vacuum pump 15 creates a vacuum in the mass-filter 11 to provide a collision-free environment for the ions. This vacuum is needed in order to prevent error in the ion's trajectories due to these collisions.

The mass-filtered ion beam is collected in a ion detector 17. Preferably, the ion detector 17 is a linear array of detector elements which makes possible the simultaneous detection of a plurality of the constituents of the sample gas. A microprocessor 19 analyses the detector output to determine the chemical makeup of the sampled gas using well-known algorithms which relate the velocity of the ions and their mass. The results of the analysis generated by the microprocessor 19 are provided to an output device 21 which can comprise an alarm, a local display, a transmitter and/or data storage. The display can take the form shown at 21 in FIG. 1 in which the constituents of the sample gas are identified by the lines measured in atomic mass units (AMU).

Preferably, mass-spectrograph 1 is implemented in a semiconductor chip 23 as illustrated in FIG. 2. In the preferred spectrograph 1, chip 23 is about 20 mm long, 10 mm wide and 0.8 mm thick. Chip 23 comprises a substrate of semiconductor material formed in two halves **25*a* and 25*b* which are joined along longitudinally extending parting surfaces 27*a* and 27*b*. The two substrate halves 25*a* and 25*b* form at their parting surfaces 27*a* and 27*b* an elongated cavity 29. This cavity 29 has an inlet section 31, a gas ionizing section 33, a mass filter section 35, and a detector section 37. A number of partitions 39 formed in the substrate extend across the cavity 29 forming chambers 41. These chambers 41 are interconnected by aligned apertures 43 in the partitions 39 in the half 25*a* which define the path of the gas through the cavity 29. Vacuum pump 15 is connected to each of the chambers 41 through lateral passages 45 formed in the confronting surfaces 27*a* and 27*b*. This arrangement provides differential pumping of the chambers 41** and makes it possible to achieve the pressures and pump displacement volume or pumping speed required in the mass filter and detector sections with a miniature vacuum pump.

In order to evacuate cavity 29 and draw a sample of gas into the spectrograph 1, pump 15 must be capable of operation at very low pressures. Moreover, because of size constraints, pump 15 must be micro-miniature in size. Although a number of prior art micro-pumps have been described, these pumps have generally focused on the pumping of liquids. In addition, micro-pumps have been used to pump gases near or higher than atmospheric pressure. Moreover, such micro-pumps are fabricated by bulk micro-machining techniques wherein several silicon or glass wafers are bonded together. This is a cumbersome procedure which is less than fully compatible with integrated circuit applications. Accordingly, there is a need for a micro-miniature diaphragm pump capable of pumping gases at low pressures which can be fabricated with ease.

SUMMARY OF THE INVENTION

A micro-miniature pump is provided for use in a solid state mass-spectrograph which can pump gases at low pressure. The solid state mass-spectrograph is constructed upon a semiconductor substrate having a cavity provided therein. The pump is connected to various portions of the cavity, thereby allowing differential pumping of the cavity. The pump preferably comprises at least one piezoelectrically-actuated diaphragm. Upon piezoelectrical actuation, the diaphragm accomplishes a suction or compression stroke. The suction stroke evacuates the portion of the cavity to which the pump is connected. The compression stroke increases the pressure of the gas in the cavity moving it into the next pump stage or exhausting it to the ambient atmosphere. Preferably, the diaphragm is formed from a pair of electrodes sandwiching a piezoelectric layer. If desired, the pumps may be ganged, in series or parallel, to increase throughput or to increase the ultimate level of vacuum achieved.

BRIEF DESCRIPTION OF THE DRAWINGS

A full understanding of the invention can be gained from the following description of the preferred embodiments when read in conjunction with the accompanying drawings in which:

FIG. 3 is a schematic view of a three-membrane piezoelectric diaphragm pump formed in accordance with the present invention.

FIG. 4 is a cross-sectional view of a presently preferred embodiment of the pump of FIG. 3.

FIG. 5 is a top view of a split electrode piezoelectric diaphragm pump of the present invention.

FIG. 6 is a cross sectional view of the pump of FIG. 5.

DETAILED DESCRIPTION OF THE PREFERRED EMBODIMENTS

Figure 1:
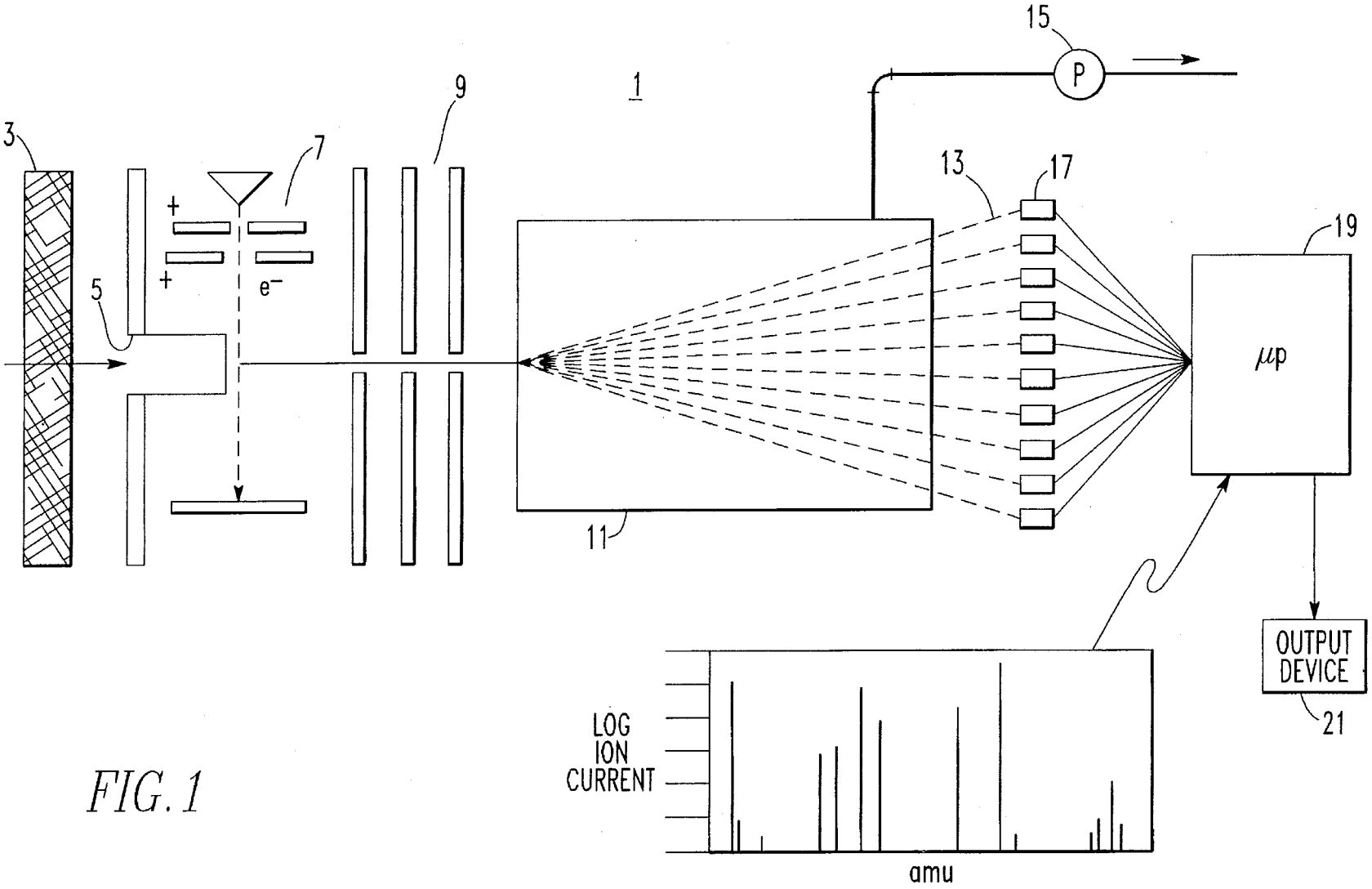
FIG. 1 is a functional diagram of a solid state mass-spectrograph in accordance with the invention.
Figure 2:
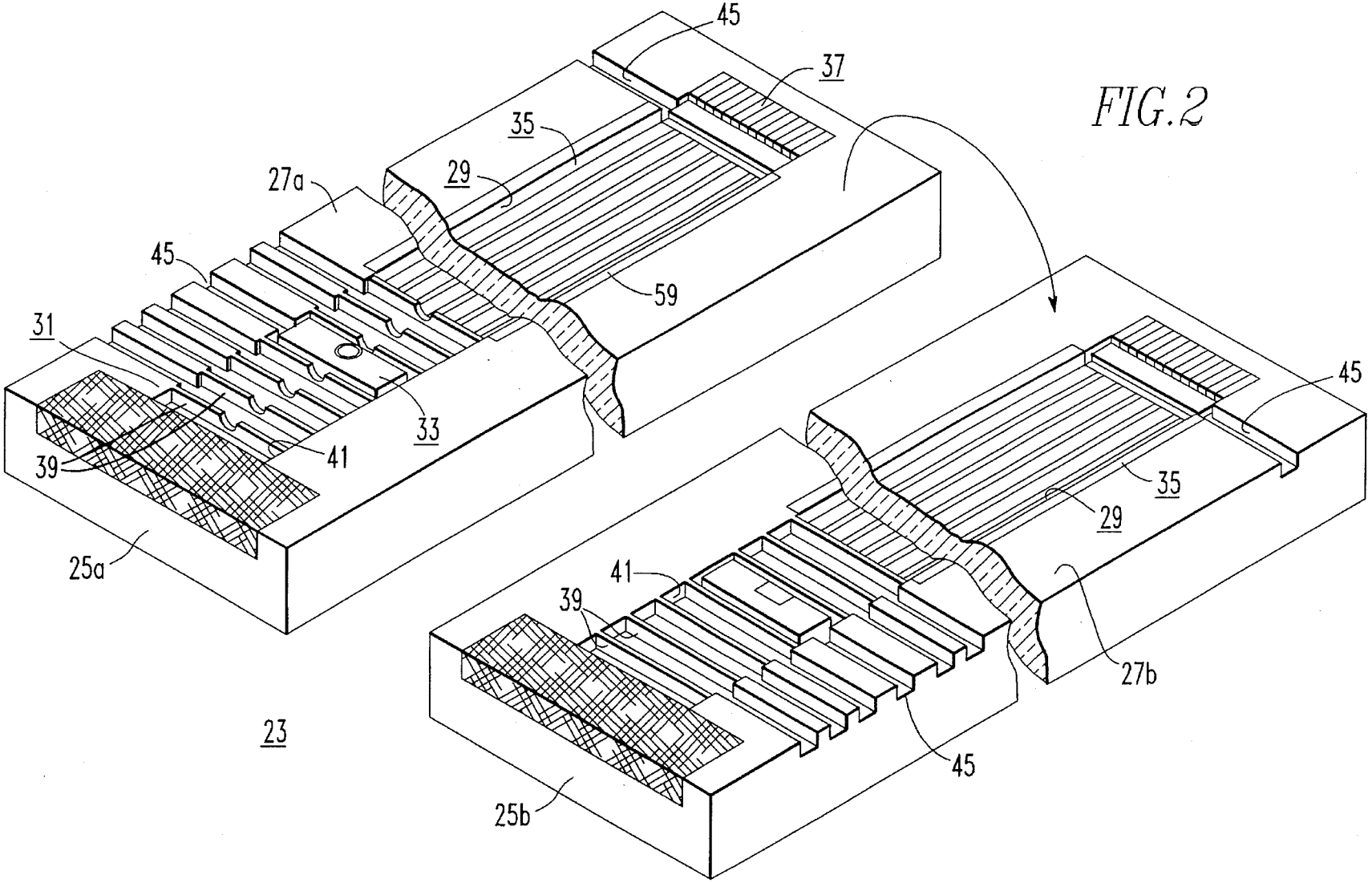
FIG. 2 is an isometric view of the two halves of the mass-spectrograph of the invention shown rotated open to reveal the internal structure.

Many types of microsensors require a gas sample to be drawn inside of the sensor. In particular, mass-spectrograph 1 needs a gas sample, reduced in pressure to the range of 1–10 milliTorr. An on-chip vacuum pump, manufacturable with silicon integrated circuit technology and thus compatible with mass-spectrograph 1, or other integrated circuit microsensors, is required.

FIG. 3 shows a top view of the presently preferred basic pumping unit 47, consisting of three diaphragms 49, 51 and 53 which are connected by gas channels 55. In addition, diaphragm 49 is connected to gas inlet 57 and diaphragm 53 is connected to gas outlet 59. When electrically biased to about +/–50 volts, these diaphragms 49, 51, and 53 flex upwards and/or downwards to produce forces in diaphragms 49, 51, and 53 sufficiently large to do the suction or compression work against the exterior ambient atmosphere.

Usually, fluids are pumped in a diaphragm pump in a peristaltic fashion. Alternatively, the first diaphragm 49 can be used as an inlet valve, the middle diaphragm 51 used as the pump, and the third diaphragm 53 used as an outlet valve. The diaphragms 49, 51 and 53 and pumps 47 may be ganged, in series or parallel, to increase throughput or to increase the ultimate level of vacuum achieved. Pump 47 is capable of evacuating gases to low pressures and is completely surface micromachined.

FIG. 4 shows a cross sectional view of one diaphragm of pump 47. To fabricate this pump, a silicon wafer substrate 61 is first patterned and etched to form the gas cavity 63. This chamber is typically 1–6 microns in depth, with a diameter of 100–1000 microns.

As an option, a layer of silicon nitride dielectric 65, followed by a patterned layer of doped polycrystalline silicon 67 and another layer of silicon nitride 69, may be deposited into the bottom of the cavity 63. This forms an optional electrostatic electrode 71, useful in ensuring a tight seal and high clamping forces when the diaphragm touches the bottom of the cavity 63. Alternatively, the silicon substrate 61 itself may be used as a common lower electrode.

A layer of silicon dioxide, not shown, is next deposited and planarized to fill the cavity 63. This layer is temporary, and forms a sacrificial material to be removed later in the fabrication.

A layer of low-stress silicon nitride 73 is next deposited. Typically this layer is 0.5–2 microns in thickness. This forms the main membrane 73 to the diaphragm pump 47.

Optionally, one layer of patterned doped polycrystalline silicon 77 and another layer of silicon nitride 75 can be deposited. These layers 75 and 77 form an upper electrostatic electrode 79.

A layer of doped polycrystalline silicon 81, followed by a metal layer 83, is then deposited. Layers 81 and 83 form the lower piezoelectric electrode 85. Typically, metal 83 is titanium to promote adhesion of lower piezoelectric electrode 85 to the polycrystalline silicone 81. A layer of platinum 87 is deposited on electrode 85 to serve as a nucleation and growth surface for the piezoelectric, preferably PZT, layer 89 which is deposited next.

The PZT ($PbZrTiO_3$) layer 89 is the main actuator of vacuum pump 47. The PZT layer 89 may be deposited by sol-gel, sputtering, or laser ablation techniques. Typically, layer 89 is between 0.3 and 0.7 microns thick.

Another metal layer 91, which forms the upper piezoelectric electrode 93, is deposited on top of the PZT layer 89. The upper electrode 93, PZT layer 89, and lower electrode 85 are next patterned. The piezoelectric stack 95 formed by electrode 93, PZT layer 89, and electrode 85 may be smaller than the diameter of cavity 63 as shown schematically in FIG. 4, or it may be larger. Additionally, as shown in FIGS. 5 and 6, the electrodes 85 and 93 may be split into rings 97 and 99 to allow separate electrical actuation. By biasing the rings to opposite polarity, different directions to the curvature of piezoelectric stack 95 may be created, aiding in the flexing of the membrane 73.

A dielectric layer is then deposited over the top of the piezoelectric stack 95, and covered with metal connected by a via hole 101 to the top piezoelectric electrode 93. The metal covering provides the electrical connection to electrode 93, and the dielectric provides electrical isolation from the substrate 61 and other electrodes.

The entire wafer is then covered in a protective encapsulant, typically 0.5 microns of PECVD amorphous silicon. Holes are etched through this encapsulant to permit hydrofluoric acid to dissolve the sacrificial silicon oxide layer in the cavity 63. The encapsulant protects the other features from attack by the acid. These holes are then sealed by sputtered silicon nitride caps.

Once formed, pump 47 is air-tight. All processing has been accomplished from the front surface of the wafer. No back side etching of the wafers is needed, nor do other wafers need to be bonded to the top or bottom of the patterned wafer. All etching and depositions have been carried out by surface micro-machining.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims in any and all equivalents thereof.

We claim:

1. A pump for use in a solid state mass spectrograph for analyzing a sample gas, said mass spectrograph being formed from a semiconductor substrate having a cavity with an inlet, a gas ionizing section adjacent said inlet, a mass filter section adjacent said gas ionizing section and a detector section adjacent said mass filter section, said pump being connected to said cavity, said pump comprising at least one piezoelectrically-actuated diaphragm means, said diaphragm means accomplishing one of a suction stroke and a compression stroke upon piezoelectrical actuation, whereby said suction stroke evacuates said cavity and draws said sample gas into said cavity and said compression stroke increases the gas pressure within said pump and ejects said sample gas from said pump and said mass spectrograph.

2. The pump of claim 1 wherein at least three diaphragms are connected together and operate in a peristaltic fashion.

3. The pump of claim 1 wherein said piezoelectrically-actuated diaphragm means is a piezoelectric stack formed from a pair of electrodes sandwiching a piezoelectric layer.

4. The pump of claim 3 wherein said piezoelectric layer is formed from $PbZrTiO_3$.

5. The pump of claim 3 wherein a lower of said pair of electrodes is formed from a layer of doped polycrystalline silicon upon which at least one metal layer is applied.

6. The pump of claim 5 wherein said metal layer is one of titanium and platinum.

7. The pump of claim 5 wherein separate layers of titanium and platinum are applied upon said layer of doped polycrystalline silicon.

8. The pump of claim 3 wherein an upper of said pair of electrodes is formed from a metal layer.

9. The pump of claim 3 wherein said pair of electrodes are shaped as concentric rings on the surface of said membrane.

10. The pump of claim 1 wherein said pump is fabricated in a silicon substrate by a. forming a cavity in said substrate;

b. filling said cavity with a layer of silicon dioxide;

c. applying a layer of silicon nitride above said cavity to form a membrane;

d. applying a lower electrode over said membrane;

e. applying a piezoelectric layer above said lower electrode;

f. applying an upper electrode above said piezoelectric layer;

g. encapsulating said substrate and layers with a silicon encapsulant;

h. dissolving said silicon dioxide layer to expose said cavity; and i. sealing said cavity.

11. The pump of claim 10 wherein a lower electrostatic electrode is provided in said cavity before said layer of silicon dioxide is filled in said cavity.

12. The pump of claim 11 wherein said lower electrostatic electrode is formed from a patterned layer of polycrystalline silicon sandwiched within a silicon nitride dielectric.

13. The pump of claim 10 wherein an upper electrostatic electrode is provided above said membrane.

14. The pump of claim 13 wherein said upper electrostatic electrode is formed from a patterned layer of polycrystalline silicon sandwiched within a silicon nitride dielectric.

15. The pump of claim 10 wherein said lower electrode is formed from a layer of doped polycrystalline silicon upon which at least one metal layer is applied.

16. The pump of claim 15 wherein said metal layer is one of titanium and platinum.

17. The pump of claim 15 wherein separate layers of titanium and platinum are applied upon said layer of doped polycrystalline silicon.

18. The pump of claim 10 wherein said piezoelectric layer is formed from $PbZrTiO_3$.

19. The pump of claim 10 wherein said upper electrode is formed from a metal layer.

20. The pump of claim 10 wherein said upper and lower electrodes are shaped as concentric rings on the surface of said membrane.

21. A pump comprising at least one piezoelectrically-actuated diaphragm means, said diaphragm means accomplishing one of a suction stroke and a compression stroke upon piezoelectrical actuation, whereby said suction stroke evacuates said pump and said compression stroke increases the fluid pressure within said pump and ejects said fluid from said pump.

22. The pump of claim 21 wherein at least three diaphragms are connected together and operate in a peristaltic fashion.

23. The pump of claim 21 wherein said piezoelectrically-actuated diaphragm means is a piezoelectric stack formed from a pair of electrodes sandwiching a piezoelectric layer.

24. The pump of claim 23 wherein said piezoelectric layer is formed from $PbZrTiO_3$.

25. The pump of claim 23 wherein a lower of said pair of electrodes is formed from a layer of doped polycrystalline silicon upon which at least one metal layer is applied.

26. The pump of claim 25 wherein said metal layer is one of titanium and platinum.

27. The pump of claim 25 wherein separate layers of titanium and platinum are applied upon said layer of doped polycrystalline silicon.

28. The pump of claim 23 wherein an upper of said pair of electrodes is formed from a metal layer.

29. The pump of claim 23 wherein said pair of electrodes are shaped as concentric rings on the surface of said membrane.

* * * * *